US008134062B2

(12) United States Patent
Kim et al.

(10) Patent No.: US 8,134,062 B2
(45) Date of Patent: Mar. 13, 2012

(54) APPARATUS AND METHOD FOR GENERATING MUSIC USING BIO-SIGNAL

(75) Inventors: Jae-Pil Kim, Seongnam-si (KR); Sun-Tae Jung, Yongin-si (KR)

(73) Assignee: Samsung Electronics Co., Ltd (KR)

( * ) Notice: Subject to any disclaimer, the term of this patent is extended or adjusted under 35 U.S.C. 154(b) by 0 days.

(21) Appl. No.: 12/700,145

(22) Filed: Feb. 4, 2010

(65) Prior Publication Data

US 2010/0192754 A1 Aug. 5, 2010

(30) Foreign Application Priority Data

Feb. 4, 2009 (KR) ..... 10-2009-0008819

(51) Int. Cl.
*G10H 1/40* (2006.01)
*G10H 7/00* (2006.01)

(52) U.S. Cl. ..... 84/611; 84/645

(58) Field of Classification Search ..... 84/645, 84/609–611

See application file for complete search history.

(56) References Cited

U.S. PATENT DOCUMENTS

| | | | | |
|---|---|---|---|---|
| 7,741,554 | B2 * | 6/2010 | Sasaki et al. | 84/609 |
| 8,022,287 | B2 | 9/2011 | Yamashita et al. | |
| 2001/0035087 | A1 * | 11/2001 | Subotnick | 84/600 |
| 2008/0257133 | A1 * | 10/2008 | Sasaki et al. | 84/604 |
| 2008/0288095 | A1 | 11/2008 | Miyajima et al. | |
| 2010/0186577 | A1 * | 7/2010 | Kim et al. | 84/612 |

FOREIGN PATENT DOCUMENTS

| | | |
|---|---|---|
| JP | 8-328555 | 12/1996 |
| JP | 2002-268635 | 9/2002 |
| JP | 2005-034391 | 2/2005 |
| JP | 2006-171133 | 6/2006 |
| KR | 1020050066701 | 6/2005 |
| KR | 1020070059102 | 6/2007 |

* cited by examiner

*Primary Examiner* — Jeffrey Donels

(74) *Attorney, Agent, or Firm* — The Farrell Law Firm, P.C.

(57) ABSTRACT

An apparatus and method for generating music is provided. A bio-signal measurer measures a bio-signal of a user. A bio-signal configuration information extractor extracts bio-signal configuration information from the measured bio-signal. A music composition information setter matches the extracted bio-signal configuration information to music composition information for composing a music file and sets a result of the matching as set music composition information. A melody composer composes a melody including the set music composition information. A music file generator generates a music file including the composed melody.

12 Claims, 4 Drawing Sheets

| | | | | | | |
|---|---|---|---|---|---|---|
| 90h | 41 | 54 | 06 | 41 | 00 | 12 |

APPARATUS AND METHOD FOR GENERATING MUSIC USING BIO-SIGNAL

PRIORITY

This application claims priority under 35 U.S.C. §119(a) to a Korean Patent Application filed in the Korean Intellectual Property Office on Feb. 4, 2009 and assigned Serial No. 10-2009-0008819, the entire disclosure of which is incorporated herein by reference.

BACKGROUND OF THE INVENTION

1. Field of the Invention

The present invention relates generally to an apparatus and method for generating music, and more particularly, to an apparatus and method for generating music files including Musical Instrument Digital Interface (MIDI) files using bio-signals including ElectroCardioGram (ECG) signals and PhotoPlethysmoGraphy (PPG) signals.

2. Description of the Related Art

Conventional sound source players employ a technique for changing feature information of music, such as measure, rhythm, and tempo, using a bio-signal. In reconfiguring the sound source, the conventional sound source player reflects the user's mood or preference, surroundings, etc. in the sound source in real time. Conventional sound source players receive a user's pulse rate or surrounding information from a sensor and remix the sound source based on the received information.

New music players have been developed that can generate music directly from a bio-signal. Such sound source players generate major sounds by matching amplitudes of an ECG signal to the 88 keys of a piano keyboard, inserting a silent interval between ECG samples, and harmonizing the features that are output when passing the ECG signal through a particular band pass filter.

Since conventional music players that convert musical pieces using bio-signals convert the musical piece using conventional applications, the conventional music players tend to convert musical pieces into sound sources in which the users' preferences, rather than the bio-signals, are reflected.

As conventional music players simply use bio-signals as a tool for converting a musical piece, the conventional music players cannot reflect the important information such as users' health conditions that can be examined using the bio-signal.

In addition, since conventional music players use amplitudes of ECG signals based on original ECG data, the conventional players may generate a strange music due to noises included in the original ECG data, and the conventional players should annoyingly set a particular silent interval between samples.

SUMMARY OF THE INVENTION

An aspect of the present invention addresses at least the above-mentioned problems and/or disadvantages and provides at least the advantages described below. Accordingly, an aspect of the present invention provides an apparatus and method for setting music composition information using a bio-signal and generating music including the set music composition information According to one aspect of the present invention, there is provided an apparatus for generating music, in which a bio-signal measurer measures a bio-signal of a user, a bio-signal configuration information extractor extracts bio-signal configuration information from the measured bio-signal, a music composition information setter matches the extracted bio-signal configuration information to music composition information for composing a music file and sets a result of the matching as set music composition information, a melody composer composes a melody including the set music composition information, and a music file generator generates a music file including the composed melody.

According to another aspect of the present invention, there is provided a method for generating music, in which a bio-signal of a user is measured by a bio-signal measurer, bio-signal configuration information is extracted from the measured bio-signal by a bio-signal configuration information extractor, the extracted bio-signal configuration information is matched to music composition information for composing a music file by a music composition information setter, a result of the matching is set as the music composition information by the music composition information setter, a melody including the set music composition information is composed by a melody composer, and a music file including the composed melody is generated by a music file generator.

BRIEF DESCRIPTION OF THE DRAWINGS

The above and other aspects, features and advantages of certain embodiments of the present invention will be more apparent from the following description taken in conjunction with the accompanying drawings, in which.

DETAILED DESCRIPTION OF EMBODIMENTS OF THE INVENTION

The matters defined in the description such as a detailed construction and elements are provided to assist in a comprehensive understanding of exemplary embodiments of the invention. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

Figure 1:
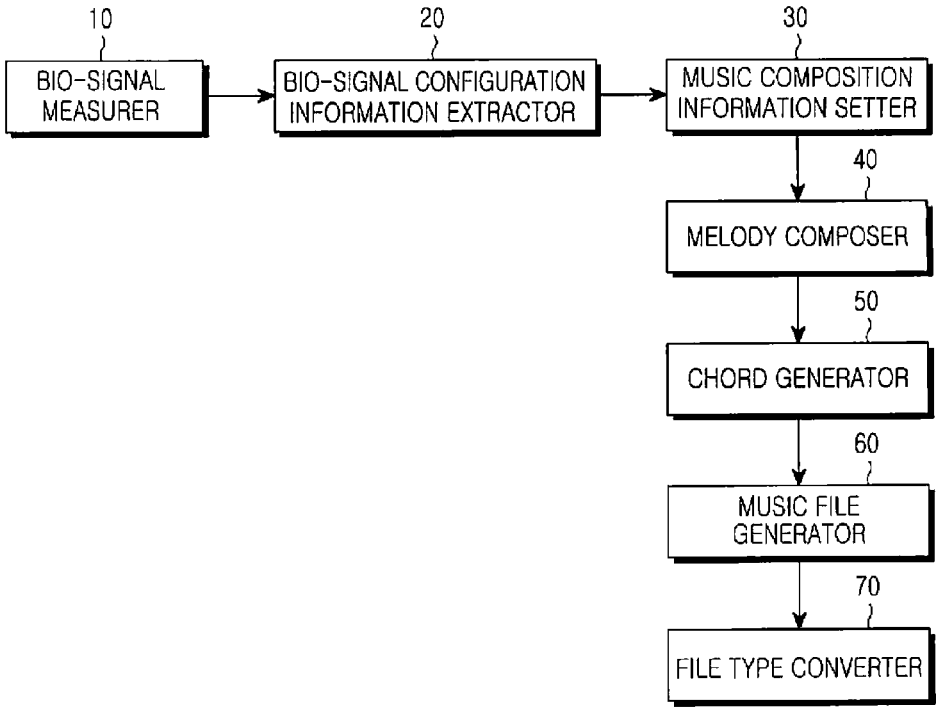
FIG. 1 is a block diagram of a music generation apparatus according to an embodiment of the present invention.

FIG. 1 illustrates block diagram of a music generation apparatus according to an embodiment of the present invention. A music file composed according to an embodiment of the present invention illustrated in FIG. 1 is assumed to be a Music Instrument Digital Interface (MIDI) file, for example. However, other music file types may be used according to the present invention. Generally, according to MIDI, which includes a signal system between digital instruments supporting MIDI, a file records a player's actions or controls corresponding to actions. However, a sound itself is not generally included in a MIDI file.

The music generation apparatus according to FIG. 1 includes a bio-signal measurer 10, a bio-signal configuration information extractor 20, a music composition information setter 30, a melody composer 40, a chord generator 50, a music file generator 60, and a file type converter 70.

The bio-signal measurer 10 measures a bio-signal such as an ECG signal or a PPG signal upon receiving a request for generation of a music file from a user.

The bio-signal configuration information extractor 20 calculates a Heart Rate Variability (HRV) from the measured bio-signal, and extracts bio-signal configuration information from the calculated HRV. The extracted bio-signal configuration information includes a heart rate, a QRS R peak's amplitude, a difference between the current heart rate and the next heart rate, an average heart rate, and an increment for an RR interval that is an interval between QRS R peak's amplitudes.

The music composition information setter 30 matches the extracted bio-signal configuration information to MIDI music composition information for composing a MIDI file, and sets the matched bio-signal configuration information as MIDI music composition information. The MIDI music composition information includes a note number, a sound intensity, a sound duration, a time base and measure, and a number of bars.

Specifically, the bio-signal configuration information may be matched to MIDI music composition information as shown in Table 1.

TABLE 1

| MIDI music composition information | Bio-signal configuration information |
|---|---|
| Note number | Heart rate |
| Sound intensity | QRS R peak's amplitude |
| Sound duration | Difference (abs) between current heart rate and next heart rate |
| Time base and measure | Average heart rate |
| Number of bars | RR interval increment |

The music composition information setter 30 sets, as a note number, each heart rate that is generated each time HRV is measured. The note number generally has a range of 0~127 as shown in Table 2, and each heart rate of 0~127 Beats Per Minute (BPM) is set as an associated note number between 0~127.

TABLE 2

| Octave | Note Numbers | | | | | | | | | | | |
|---|---|---|---|---|---|---|---|---|---|---|---|---|
| # | C | C# | D | D# | E | F | F# | G | G# | A | A# | B |
| 0 | 0 | 1 | 2 | 3 | 4 | 5 | 6 | 7 | 8 | 9 | 10 | 11 |
| 1 | 12 | 13 | 14 | 15 | 16 | 17 | 18 | 19 | 20 | 21 | 22 | 23 |
| 2 | 24 | 25 | 26 | 27 | 28 | 29 | 30 | 31 | 32 | 33 | 34 | 35 |
| 3 | 36 | 37 | 38 | 39 | 40 | 41 | 42 | 43 | 44 | 45 | 46 | 47 |
| 4 | 48 | 49 | 50 | 51 | 52 | 53 | 54 | 55 | 56 | 57 | 58 | 59 |
| 5 | 60 | 61 | 62 | 63 | 64 | 65 | 66 | 67 | 68 | 69 | 70 | 71 |
| 6 | 72 | 73 | 74 | 75 | 76 | 77 | 78 | 79 | 80 | 81 | 82 | 83 |
| 7 | 84 | 85 | 86 | 87 | 88 | 89 | 90 | 91 | 92 | 93 | 94 | 95 |
| 8 | 96 | 97 | 98 | 99 | 100 | 101 | 102 | 103 | 104 | 105 | 106 | 107 |
| 9 | 108 | 109 | 110 | 111 | 112 | 113 | 114 | 115 | 116 | 117 | 118 | 119 |
| 10 | 120 | 121 | 122 | 123 | 124 | 125 | 126 | 127 | | | | |

If the heart rate exceeds the range defined in Table 2 (for example, while a user exercises), the music composition information setter 30 may adjust HRV so that the average heart rate has the range defined in Table 2.

The music composition information setter 30 sets, as a sound intensity, a QRS R peak's amplitude that is generated each time HRV is measured. Here, the sound intensity refers to the loudness/quietness of sound in music, such as forte (loud) and piano (soft), and generally has a range of 0~127.

The music composition information setter 30 sets, as a sound duration, a difference between the current heart rate and a next heart rate. Here, the sound duration generally consists of a step time and a gate time. The step time refers to a time corresponding to an actual temporal length of a note, and the gate time refers to a time for which music is played shorter than the actual temporal sound length, such as in a staccato note, for example.

The set sound duration becomes a criterion for determining a time base indicating which note is to be used as a base note.

The music composition information setter 30 sets a time base and measure based on the average heart rate.

The music composition information setter 30 can set a time base and measure by dividing an RR interval increment by the number of bars, and calculates the number of bars using a sampling rate of a heart rate wave along with the set time base and measure.

The melody composer 40 composes a melody using the set music composition information.

The chord generator 50 generates a chord for the composed melody based on the general harmonic theory.

The music file generator 60 generates a MIDI file including the melody in which a chord is set.

The file type converter 70 converts the MIDI file generated by the music file generator 60 into a Motion Picture experts' group audio layer-3 (MP3) or WAV file.

A process of generating a music file in the music generation apparatus will be described in detail below with reference to FIG. 2.

Figure 2:
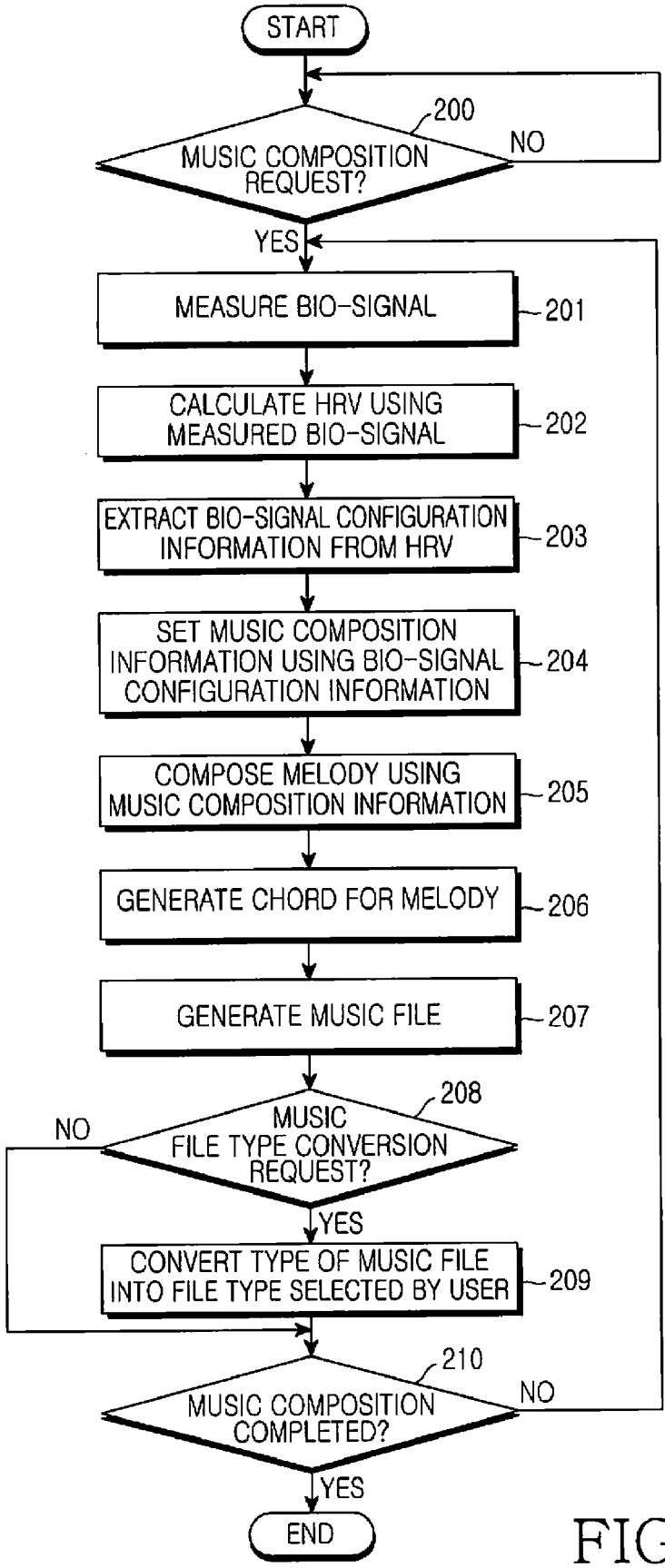
FIG. 2 is a flowchart illustrating a process for generating music using a bio-signal in a music generation apparatus according to an embodiment of the present invention.

Referring to FIG. 2, a flowchart illustrates a process for generating a music file using a bio-signal in a music generation apparatus according to an embodiment of the present invention, in which the music file is assumed to be a MIDI file.

In step 200, the bio-signal measurer 10 determines whether a request for music composition is received. Upon receiving the request, the bio-signal measurer 10 proceeds to step 201. Otherwise, the bio-signal measurer 10 continues to check for a music composition request.

In step 201, the bio-signal measurer 10 measures a bio-signal such as an ECG signal or a PPG signal.

Figure 4:
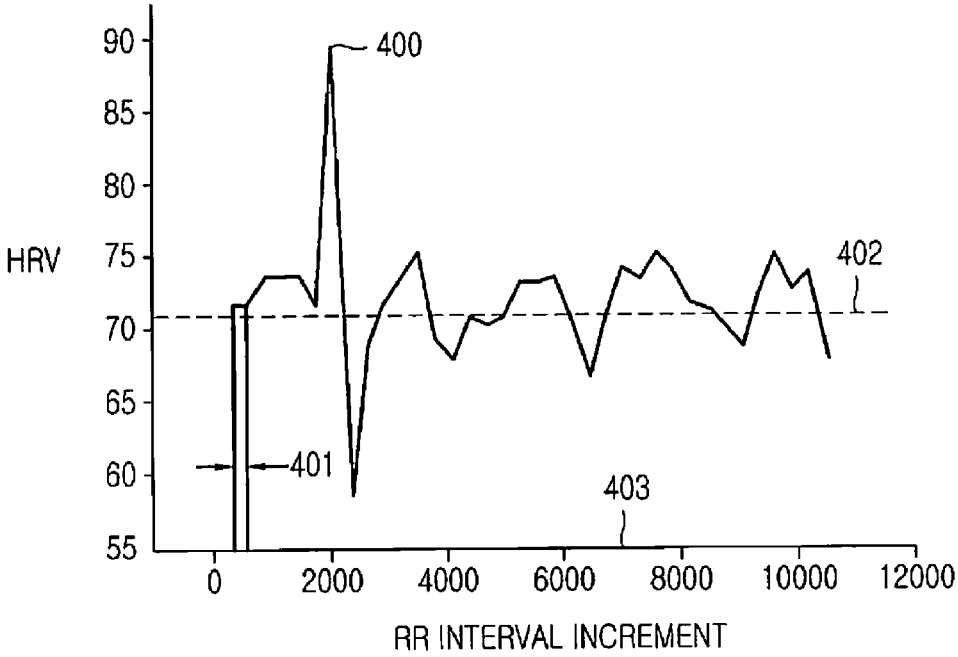
FIG. 4 is a graph illustrating bio-signal configuration information extracted according to an embodiment of the present invention.

In step 202, the bio-signal configuration information extractor 20 calculates HRV from the measured bio-signal. The calculated HRV can be shown in a graph, such as the graph illustrated in FIG. 4 according to an RR interval. Referring to FIG. 4, reference numeral 400 represents a QRS R peak's amplitude, reference numeral 401 represents a difference between the previous heart rate and the current heart rate, reference numeral 402 represents an average heart rate, and reference numeral 403 represents an RR interval increment.

In step 203, the bio-signal configuration information extractor 20 extracts bio-signal configuration information from the calculated HRV. The extracted bio-signal configuration information, as shown in FIG. 4, includes a heart rate, a QRS R peak's amplitude, a difference between the previous heart rate and the current heart rate, an average heart rate, and an RR interval increment.

In step 204, the music composition information setter 30 matches of the extracted bio-signal configuration information to MIDI music composition information, and sets the matched bio-signal configuration information as MIDI music composition information.

Referring to FIG. 4, the music composition information setter 30 sets the QRS R peak's amplitude 400 as a sound intensity, and sets the difference 401 between the previous heart rate and the current heart rate as a sound duration. The music composition information setter 30 sets a time base and measure using the average heart rate 402, and sets the RR interval increment 403 as the number of bars.

Figure 3:
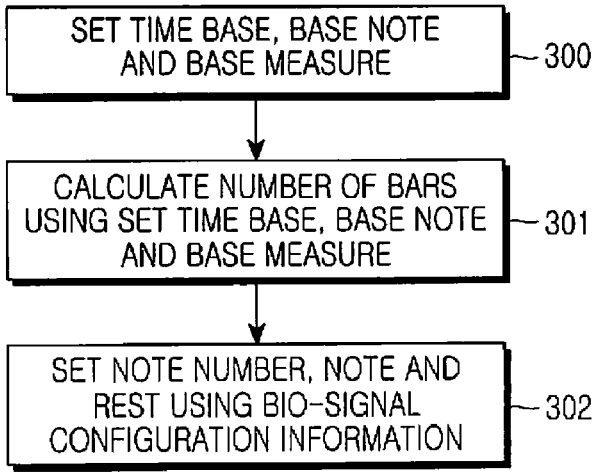
FIG. 3 is a flowchart illustrating a process of setting music composition information in a music composition information setter according to an embodiment of the present invention.

FIG. 3, illustrates process of setting the bio-signal configuration information as MIDI composition information in the music composition information setter 30 in step 204.

In step 300, the music composition information setter 30 sets a time base, a base note, and a base measure according to the average heart rate. The time base is a time figure of a quarter note, and refers to a value for determining a length of the quarter note, and the measure refers to a value indicating the number of quarter notes included in each bar. Specifically, the music composition information setter 30 can set a time base by setting 1 as a quarter note. In setting a measure, the music composition information setter 30 can set an average heart rate or below as a four-quarter measure and an average heart rate or above as a two-quarter measure.

In step 301, the music composition information setter 30 calculates the number of bars using the set time base and base measure. The number of bars is calculated using Equation (1):

$$\text{Index value constituting 1 bar}=(\text{Sampling Rate}/\text{Resolution of 1 Measure})\times\text{Measure Number}\times\text{Sampling Rate} \quad (1)$$

For example, when the number of bars is calculated using a 350-Hz ECG wave having a time base of 48 and a four-quarter measure, an index value constituting 1 bar becomes (350 Hz/240)×4×350 Hz=2041, assuming that a resolution of 1 measure is 240. In this example, a note number, a sound intensity, a sound duration, and a time base and measure that exist in about 2041 indexes become bar components constituting one bar.

In step 302, the music composition information setter 30 sets bar components using RR interval among the bio-signal configuration informations. The bar components include a note number, a note, and a rest. A a process of setting bar components in the music composition information setter 30 is described as follows, with reference to Table 3.

TABLE 3

| RR interval | RR interval increment | Heart rate (bpm) | Approximate heart rate | Bars | Note number | Adjusted note number | Scale | Heart rate difference |
|---|---|---|---|---|---|---|---|---|
| 235 | 1967 | 89.362 | 89 | | F7 | F5 | Fa | 18 |
| 358 | 2325 | 58.659 | 59 | | B4 | B2 | Si | 30 |
| 304 | 2629 | 69.079 | 69 | | A5 | A5 | La | 10 |
| 292 | 2921 | 71.918 | 72 | | C6 | C4 | Do | 3 |
| 284 | 3205 | 73.944 | 74 | | D6 | D4 | Re | 2 |
| 278 | 3483 | 75.54 | 76 | | E6 | E4 | Mi | 2 |
| 302 | 3785 | 69.536 | 70 | 2 | A#5 | A3 | Fa | 6 |

For example, when an RR interval is 235 and an increment of the RR interval is 1967, the heart rate is calculated as 89.362 BPM (350 Hz/235×60). The music composition information setter 30 calculates an approximate heart rate with values below a decimal point excluded, to match the note number to the heart rate.

Based on the note number in Table 2, the music composition information setter 30 calculates a note number corresponding to the calculated approximate heart rate among note numbers between 0 and 127. The calculated note number is F7. Since the calculated note number F7 has too high of an octave, the music composition information setter 30 may discretionally adjust the note number.

The music composition information setter 30 calculates a note or a rest using the time base, the base measure, the base note and the heart rate difference among the bio-signal configuration informations.

For example, it is assumed that a second bar of a four-quarter measure is composed as defined in Table 4 below. Notes included in the composed bar are calculated using Equation (2):

$$\text{Note}=\text{Base Measure}\times\text{Heart Rate Difference}/\text{Sum of Heart Rate Differences} \quad (2)$$

Here, the base measure is 4, and the sum of heart rate differences is 18+30+10+3+2+2+6=71.

If the set base note is an eighth note (0.5 measure or time), notes based on the note numbers in Table 3 are calculated as shown in Table 4 below.

TABLE 4

| Note number | Calculation | Result | Resultant note |
|---|---|---|---|
| Fa | 4 * 18/71 | 1 | ♩ |
| Si | 4 * 30/71 | 1.69 | ♩ |
| La | 4 * 10/71 | 0.5 | ♪ |
| Do | 4 * 3/71 | 0.16 | Rest |
| Re | 4 * 2/71 | 0.1 | Rest |
| Mi | 4 * 2/71 | 0.1 | Rest |
| La | 4 * 6/71 | 0.3 | Rest |

Referring to FIG. 2, in step 205, the melody composer 40 composes a melody including the set music composition informations. The composed melody can be represented as FIG. 5.

In step 206, the chord generator 50 generates a chord for the composed melody based on the general harmonic theory. For example, when generating a chord for "Mi" among the note numbers included in the melody, the chord generator 50 can generate a chord made by including "Do" and "Sol" in "Mi" based on a chord "Do-Mi-Sol."

Figures 5, 6:
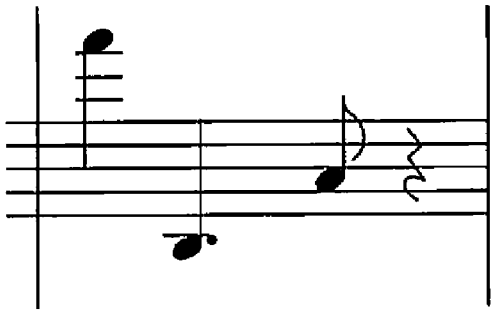
FIG. 5 is a diagram illustrating a melody composed according to an embodiment of the present invention.
FIG. 6 is a diagram illustrating a music file generated according to an embodiment of the present invention.

In step 207, the music file generator 60 generates a music file including the composed melody. If the generated music file is a MIDI file, the MIDI file can be composed as illustrated in FIG. 6. Referring to FIG. 6, 90h refers to pressing a key on the keyboard 0 refers to an output channel. Here, an output channel 0 indicates a first channel. Further, 41 represents a note number in hexadecimal, and is equivalent to 65 in decimal, i.e. F (Fa) of an octave 5. 54 represents a sound intensity in hexadecimal and has a value range of 0~127, and the sound intensity can be represented as 84 in decimal. 06 represents a sound duration. In combination, "90h 41 54 06" becomes a component representing one sound.

In step 208, the file type converter 70 determines whether a request for converting a music file type is received. If there is the request, the file type converter 70 goes to step 209. Otherwise, the file type converter 70 continues to determine a request for requesting a music file type is received, in step 208.

In step 209, the file type converter 70 converts the generated music file into a file type selected by the user. For example, the file type converter 70 converts a MIDI file into an MP3 or WAV file.

If the music composition is not completed in step 210, the bio-signal measurer 10 measures a new bio-signal in step 201, and the music generation apparatus repeats steps 202 to 210.

As can be appreciated from the foregoing description, an embodiment of the present invention includes measuring a user's bio-signal such as ECG and PPG, setting music composition information by extracting bio-signal configuration information from the measured bio-signal, and then generating music using the set music composition information, thereby making it possible to generate music based on the user's bio-signal.

Embodiments of the present invention can generate music based on a user's bio-signal such as ECG and PPG.

Further, embodiments of the present invention can generate music using HRV from which a user's health condition can be predicted, so the user may check his/her health condition by listening to the generated music.

In addition, embodiments of the present invention can generate music having a small amount of data by using a bio-signal generated over a short period of time, so that a mobile communication device can use the generated music as various forms of content, including a bell sound, for example.

While the invention has been shown and described with reference to certain exemplary embodiments thereof, it will be understood by those skilled in the art that various changes in form and details may be made therein without departing from the spirit and scope of the invention as defined by the appended claims and their equivalents.

What is claimed is:

1. An apparatus for generating music, comprising:

a bio-signal measurer for measuring a bio-signal of a user;

a bio-signal configuration information extractor for extracting bio-signal configuration information from the measured bio-signal;

a music composition information setter for matching the extracted bio-signal configuration information to stored music composition information for composing a music file, and setting a result of the matching as set music composition information;

a melody composer for composing a melody including the set music composition information;

a chord generator for generating a chord for each of at least one note number included in the melody; and a music file generator for generating a music file including the composed melody.

2. The apparatus of claim 1, wherein the bio-signal includes at least one of an ElectroCcardioGram (ECG) and a PhotoPlethysmoGraphy (PPG).

3. The apparatus of claim 1, wherein the bio-signal configuration information includes at least one of a heart rate, an amplitude of a QRS R peak, a difference between a previous heart rate and a current heart rate, an average heart rate, and an RR interval increment.

4. The apparatus of claim 3, wherein the set music composition information includes at least one of a note number, a sound intensity, a sound duration, a time base and measure, and a number of bars.

5. The apparatus of claim 1, further comprising a file type converter for converting the generated music file into a music file type according to a user selection, upon receiving a user-request.

6. The apparatus of claim 1, wherein the music file is a Music Instrument Digital Interface (MIDI) file.

7. A method for generating music, comprising:

measuring, by a bio-signal measurer, a bio-signal of a user;

extracting, a bio-signal configuration information extractor, bio-signal configuration information from the measured bio-signal;

matching, by a music composition information setter, the extracted bio-signal configuration information to stored music composition information for composing a music file, and setting a result of the matching as set music composition information;

composing, by a melody composer, a melody including the set music composition information;

generating a chord for each of at least one note number included in the melody after the melody composition; and generating, by a music file generator, a music file including the composed melody.

8. The method of claim 7, wherein the bio-signal includes at least one of an ElectroCardioGram (ECG) and a PhotoPlethysmoGraphy (PPG).

9. The method of claim 7, wherein the bio-signal configuration information includes at least one of a heart rate, an amplitude of a QRS R peak, a difference between a previous heart rate and a current heart rate, an average heart rate, and an RR interval increment.

10. The method of claim 9, wherein the music composition information includes at least one of a note number, a sound intensity, a sound duration, a time base and measure, and a number of bars.

11. The method of claim 7, further comprising converting the generated music file into a music file type according to a user selection, upon user request.

12. The method of claim 7, wherein the music file is a Music Instrument Digital Interface (MIDI) file.

* * * * *